US011882890B2

(12) United States Patent
Dodd

(10) Patent No.: US 11,882,890 B2
(45) **Date of Patent: *Jan. 30, 2024**

(54) PRE-KNOTTED ADJUSTABLE NECKTIE

(71) Applicant: John William Dodd, Nashville, TN (US)

(72) Inventor: John William Dodd, Nashville, TN (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/942,092

(22) Filed: Sep. 9, 2022

(65) Prior Publication Data

US 2023/0000189 A1 Jan. 5, 2023

Related U.S. Application Data

(63) Continuation of application No. 17/031,483, filed on Sep. 24, 2020, now Pat. No. 11,470,898.

(51) Int. Cl.
*A41D 25/02* (2006.01)
*A41D 25/00* (2006.01)

(52) U.S. Cl.
CPC ..... *A41D 25/025* (2013.01); *A41D 25/001* (2013.01)

(58) Field of Classification Search
CPC ..... A41D 25/14; A41D 25/02; A41D 25/001; A41D 25/025
See application file for complete search history.

(56) References Cited

U.S. PATENT DOCUMENTS 148,221 A * 3/1874 Kueppers ..... A41D 25/02 2/150
384,036 A * 6/1888 Hellenberg ..... A41D 25/022 24/66.9
490,820 A * 1/1893 Bertin ..... A41D 25/02 2/150
623,958 A * 4/1899 Hammerstein ..... A41D 25/02 2/150

(Continued)

FOREIGN PATENT DOCUMENTS

DE 8908014 U1 10/1989

OTHER PUBLICATIONS

Office Action for corresponding U.S. Appl. No. 17/031,483, dated Dec. 6, 2021, 27 pages.

*Primary Examiner* — Richale L Quinn
(74) *Attorney, Agent, or Firm* — Patterson Intellectual Property Law, P.C.; Mark A. Kilgore

(57) ABSTRACT

A pre-knotted adjustable necktie eliminates the difficulty of tying a knot with a panel of flexible material, and preserves the adjustability of a conventional necktie. The pre-knotted adjustable necktie includes: a panel of flexible material, having a proximal blade end portion, a distal tail end portion, and a middle portion; a passage through the flexible material at a location in the tail end portion proximate to the middle portion; a coupling member connecting edges of the middle portion to form a first loop; a knot having the tail end portion extending through the first loop to form a second loop, and the blade end portion extended through the first loop to form (Continued)

a third loop; and a neck loop formed by an extension of the tail end portion through the second loop and the third loop, and the tail end portion further extended through the passage.

17 Claims, 6 Drawing Sheets

(56) References Cited

U.S. PATENT DOCUMENTS 716,704 A * 12/1902 Glahn ..... A41D 25/02 2/152.1
769,506 A * 9/1904 Stark ..... A41D 25/02 2/150
772,801 A * 10/1904 Groll ..... A41D 25/02 2/150
898,198 A * 9/1908 Egberts ..... A41D 25/02 2/150
949,366 A * 2/1910 Reynolds ..... A41D 25/02 2/148
964,755 A * 7/1910 Charon ..... A41D 25/02 2/150
1,066,093 A * 7/1913 Ellison ..... A41D 25/022 2/148
1,125,793 A * 1/1915 Barnes ..... A41D 25/02 2/150
1,396,240 A * 11/1921 Bakerman ..... A41D 25/02 2/150
1,811,748 A * 6/1931 Di Tosto ..... A41D 25/04 2/150
1,847,294 A * 3/1932 Collett ..... A41D 25/04 2/150
1,859,669 A * 5/1932 Harms ..... A41D 25/027 2/150
1,878,604 A * 9/1932 Rodeback ..... A41D 25/005 D2/605
1,899,789 A * 2/1933 Barbetti ..... A41D 25/02 2/150
1,922,956 A * 8/1933 Jouffray ..... A41D 25/14 2/150
2,023,293 A * 12/1935 Sears ..... A41D 25/04 2/155
2,034,652 A * 3/1936 Fallar ..... A41D 25/16 2/150
2,040,297 A * 5/1936 Costantini ..... A41D 25/02 D2/605
2,052,522 A * 8/1936 Wagenfeld ..... A41D 25/02 2/150
2,103,094 A * 12/1937 Scharlin ..... A41D 25/02 2/150
2,123,775 A * 7/1938 Gutierrez ..... A41D 25/02 2/150
2,170,707 A * 8/1939 Chapel ..... A41D 25/02 D2/605
2,195,373 A * 3/1940 Snyder ..... A41D 25/08 2/148
2,207,119 A * 7/1940 Esposito ..... A41D 25/06 2/146
2,269,017 A * 1/1942 Gladstone ..... A41D 25/14 D2/609
2,377,019 A * 5/1945 Logan ..... A41D 25/00 D2/609
2,388,993 A * 11/1945 Pfau ..... A41D 25/04 D2/605
2,411,907 A * 12/1946 Taborski ..... A41D 25/02 D2/605
2,484,388 A * 10/1949 Reiner ..... A41D 25/16 2/146
2,648,846 A * 8/1953 Titone ..... A41D 25/02 2/150
2,738,513 A * 3/1956 Carty ..... A41D 25/003 2/145
2,907,045 A * 10/1959 O'Reilly ..... A41D 25/022 2/150
2,943,331 A * 7/1960 Toplansky ..... A41D 25/022 2/150
3,167,784 A * 2/1965 Less ..... A41D 25/00 D2/605
3,208,081 A * 9/1965 Scully ..... A41D 25/025 2/150
3,225,358 A * 12/1965 Less ..... A41D 25/00 2/150
3,263,237 A * 8/1966 Bellon ..... A41D 25/025 D2/605
3,369,257 A * 2/1968 Less ..... A41D 25/025 2/150
3,526,004 A * 9/1970 Brandenberger .... A41D 25/022 2/150
3,538,511 A * 11/1970 Aro ..... A41D 25/02 2/150
3,737,917 A * 6/1973 Orr ..... A41D 25/02 2/150
3,946,444 A * 3/1976 Parrilla ..... A41D 25/08 2/144
3,964,105 A * 6/1976 Gideon ..... A41D 25/022 24/49.1
4,710,982 A * 12/1987 Lande ..... A41D 25/008 24/388
4,777,665 A * 10/1988 Akamatsu ..... A41D 25/04 2/155
4,856,115 A * 8/1989 Knapp ..... A41D 25/04 2/155
5,165,112 A * 11/1992 Dawes ..... A41D 25/025 2/155
5,666,666 A * 9/1997 Chaffen ..... A41D 25/025 2/148
5,815,835 A * 10/1998 Craddock ..... A41D 25/00 D2/600
6,094,746 A * 8/2000 Miller ..... A41D 25/10 2/148
6,216,275 B1 * 4/2001 Lee ..... A41D 25/003 2/144
6,421,835 B1 * 7/2002 Galante ..... A41D 25/02 2/150
6,460,189 B1 * 10/2002 Welch ..... A41D 25/02 24/49.1
6,658,667 B1 * 12/2003 Galante ..... A41D 25/02 2/150
6,691,319 B1 * 2/2004 Simon ..... A41D 25/025 2/144
6,920,642 B2 * 7/2005 Dickens ..... A41D 25/022 2/152.1
7,065,794 B2 * 6/2006 Anderson ..... A41D 25/003 223/82
7,096,509 B2 * 8/2006 Kim ..... A41D 25/02 24/49.1
7,373,696 B2 * 5/2008 Schoening ..... A41D 25/003 24/66.1
7,496,972 B2 * 3/2009 Kreitz ..... A41D 25/003 2/145
7,770,238 B2 * 8/2010 Dayan ..... A41D 25/02 2/148
7,930,806 B2 * 4/2011 Funk ..... A41D 25/022 24/66.9
7,992,264 B2 * 8/2011 Abadi ..... A41F 1/002 24/49.1
8,056,147 B1 * 11/2011 Patel ..... A41D 25/003 2/145
8,584,913 B1 * 11/2013 Perlsweig ..... A41H 37/10 2/265
8,931,116 B2 1/2015 Lucero
8,938,813 B2 * 1/2015 McDowell ..... A41D 25/003 2/144
9,095,180 B1 * 8/2015 Lovett ..... A41D 25/025
9,781,961 B2 * 10/2017 Erickson ..... A41D 25/027
2009/0144945 A1 * 6/2009 Funk ..... A41D 25/022 24/66.9

(56) References Cited

U.S. PATENT DOCUMENTS

| | | | | |
|---|---|---|---|---|
| 2012/0185995 | A1* | 7/2012 | Fear | A41D 25/025 2/152.1 |
| 2013/0269083 | A1* | 10/2013 | Paglione | A41D 25/00 2/145 |
| 2014/0230126 | A1* | 8/2014 | Lucero | A41D 25/06 2/148 |
| 2014/0317831 | A1 | 10/2014 | Woody | |
| 2014/0352029 | A1* | 12/2014 | Jones | A41D 25/022 2/145 |
| 2016/0309852 | A1* | 10/2016 | Krasney | A44B 6/00 |
| 2017/0251768 | A1* | 9/2017 | Pannuzzo, Sr. | A41D 25/003 |
| 2017/0265542 | A1* | 9/2017 | Redmond | A41D 25/001 |
| 2022/0087346 | A1* | 3/2022 | Dodd | A41D 25/02 |
| 2023/0000189 | A1* | 1/2023 | Dodd | A41D 25/02 |

* cited by examiner

PRE-KNOTTED ADJUSTABLE NECKTIE

CROSS-REFERENCES TO RELATED APPLICATIONS

This application claims benefit of the following patent application(s), which is/are hereby incorporated by reference: of U.S. Non-Provisional patent application Ser. No. 17/031,483 filed Sep. 24, 2020, entitled "Pre-Knotted Adjustable Necktie".

STATEMENT REGARDING FEDERALLY SPONSORED RESEARCH OR DEVELOPMENT

Not applicable.

REFERENCE TO SEQUENCE LISTING OR COMPUTER PROGRAM LISTING APPENDIX

Not applicable.

FIELD OF THE INVENTION

The present invention relates generally to neckties. More particularly, this present invention pertains to improved pre-knotted adjustable neckties.

DESCRIPTION OF THE PRIOR ART

The unnecessary trouble of tying a necktie knot has presented a problem that many manufacturers and clothing designers have attempted to solve for necktie users. To solve this problem, manufacturers and clothing designers have generally proposed two alternative design methodologies of construction.

The first methodology accomplishes the permanent knot; however, in doing so, this methodology may sacrifice aspects of adjustability and functionality which are commonly associated with a traditional necktie, rendering the alternative nature of its design only quasi-functional and readily observable upon close visual inspection. Examples of the "permanent knot" design may include such designs as a clip-on tie and a zipper-tie. While the foregoing designs accomplish a permanent knot for the necktie, the designs lack core functionality of a traditional necktie. Specifically, the zipper-tie cannot be adjusted without rendering the alternative nature of its design visually observable, whereas the clip-on tie cannot be adjusted whatsoever.

The second methodology includes the incorporation, inclusion, or use of a device, apparatus, or other attachment, the foregoing of which are foreign to the flexible material, or clothing fabric, of the necktie. While this methodology may accomplish certain aspects related to functionality and adjustability, such aspects are only accomplished by virtue of a simulated pre-modeled knot, rendering the alternative nature of the design visually observable upon close inspection. And similar to the first methodology, while the second methodology achieves a knot for the necktie, such knot is impermanent, and only formed through participation and manipulation by the necktie user. Examples of the incorporation, inclusion, or use of a foreign device apparatus, or other attachment are disclosed in the following references: US20140317831A1, US20120185995A1, and U.S. Pat. No. 8,931,116.

Despite manufacturer's and clothing designer's attempts to develop a pre-knotted necktie, which balances functionality and adjustability with the appearance of a conventional necktie, no particular solution has been widely embraced by frequent, or even ordinary, necktie users. Accordingly, there may be long-felt need in the industry of necktie manufacturing and design to eliminate the unnecessary trouble of tying a knot with a panel of flexible material, while simultaneously preserving look, feel, functionality, and adjustability of a traditional necktie.

Previous alternative designs, such as those described in the above, may satisfy the first element. As of yet, however, no such design has satisfied the second element, because no manufacturer or clothing manufacturer has achieved a permanent knot, without compromising some aspect related to look, feel, functionality, or adjustability of a traditional necktie.

Accordingly, a need exists for an alternative design that provides a legitimate solution to the unnecessary trouble associated with traditional neckties that simultaneously (1) eliminates the unnecessary trouble of tying a knot with a panel of flexible material, and (2) preserves look, feel, functionality, and adjustability of a traditional necktie.

SUMMARY OF THE INVENTION

A principle object of the present disclosure is to provide a pre-knotted adjustable necktie. Another object of the disclosure is to provide a method by which to assemble the pre-knotted adjustable necktie.

In accordance with the objects of the disclosure, a pre-knotted adjustable necktie may include a panel of flexible material having a proximal blade end portion, a distal tail end portion, and a middle portion positioned between the blade end portion and the tail end portion, Said flexible material may include any natural or artificial fabric or fiber, which is customary for neckties and other articles of clothing. In addition, said middle portion of the pre-knotted adjustable necktie may include a stretchable or elastomeric material, such that the pre-knotted adjustable necktie may be mechanically stretched or deformed, without compromising or sacrificing its original length or shape.

Also in accordance with the objects of the disclosure, a pre-knotted adjustable necktie may include a passage incorporated or included through the panel of flexible material at a position in the tail end portion proximate to the middle portion, with the passage having sufficient dimensionality for slidable reception of the tail end. Said passage may have a circular or rectangular shape, and said passage may include a grommet, or other ring or edge strip for slidable reception of the tail end.

Also in accordance with the objects of the disclosure, a pre-knotted adjustable necktie may include a coupling member connecting a first location on an edge of the middle portion with a second location on the edge of the middle portion to form a first loop in the middle portion along the edge. Said coupling member may encompass a thread, or other fine piece of fabric or material, which may be sewn between the first location on the edge of the middle portion and the second location of the edge of the middle portion. Said coupling member may also include a thin wire, or other malleable metal or material.

Also in accordance with the objects of the disclosure, the pre-knotted adjustable necktie may include a knot having the tail end portion extending through the first loop to form a second loop, and the blade end portion extending through the first loop to form a third loop, the blade end portions extending downward from the knot. Said first loop may form a teardrop or other geometrical shape approximating a sphere or oval with an angular point or end. Said knot may form a triangular or rectangular shape, or other geometrical configuration customary for the morphology of a knot in a conventional necktie.

Also in accordance with the objects of the disclosure, a neck loop may include the tail end portion extending through the second loop, further extending through the third loop, and passing through the passage, such that the tail end portion may be movable within the third loop and the passage to adjust a length of the neck loop.

Also in accordance with the objects of the disclosure, a graspable anchor may be externally attached to, or internally incorporated within, the tail end portion to enable the tail end portion to extend through the first loop, the second loop, the third loop, and the passage.

Also in accordance with the objects of the disclosure, the pre-knotted adjustable necktie may include a slab of rigid material that is externally attached to, or internally incorporated within, the tail end portion positioned beneath the passage to prevent the tail end portion from returning through the passage and the third loop, thereby breaching the closed and confined nature of the neck loop.

Also in accordance with the objects of the disclosure, the tail end portion may house at least one magnetic plate, and the blade end portion may house at least one magnetic plate.

There has been outlined, rather broadly, some of the features of the invention so that the detailed description thereof may be better understood. There are additional features of the invention that will be described hereinafter and will form the subject matter of the claims appended hereto. It is to be understood that this invention is not limited in its application to the details of construction or to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

The present invention itself, together with further objects and attendant advantages, will be further understood by reference to the following detail description, taken in conjunction with the accompanying drawings.

BRIEF DESCRIPTION OF THE DRAWINGS

Various other objects, features, and attendant advantages of the present invention will become fully appreciated as the same becomes better understood when considered in conjunction with the accompanying drawings, in which reference characters designate the same or similar parts through the views and perspectives, and wherein.

DETAILED DESCRIPTION

Figure 1A:
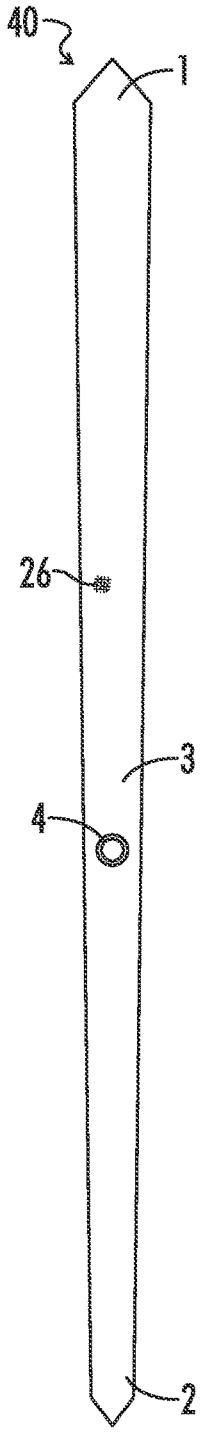
FIG. 1A illustrates a front side of a panel of flexible material.
Figure 1B:
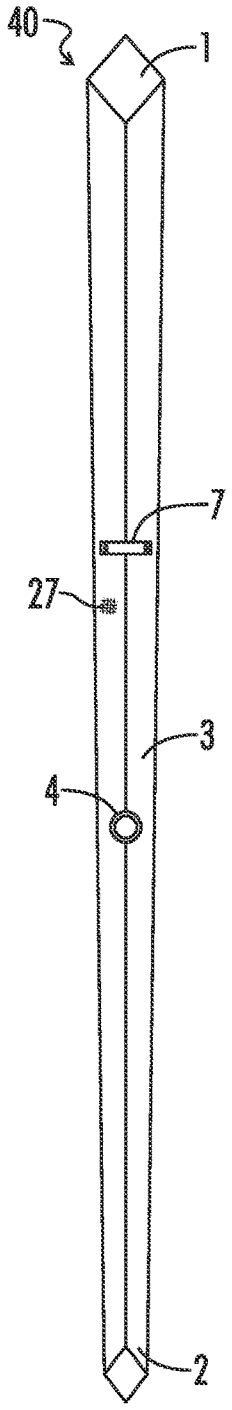
FIGS. 1B-1D illustrate a rear side of the panel of flexible material along with accompanying embodiments.

FIGS. 1A-1D depict a front and rear perspective of a pre-knotted adjustable necktie 40 prior to formation. The front perspective of the necktie 40 includes an external panel of flexible material 26 and an internal panel of flexible material 27. The pre-knotted adjustable necktie 40 includes a proximal blade end portion 1, a distal tail end portion 2, a middle portion 3, and a passage 4, the passage 4 of which may be positioned at a location in the tail end portion 2 proximate to the middle portion 3, the passage 4 having a size configured to slidably receive the tail end portion 1. The internal panel of the flexible material 27 further includes a keeper 7, the keeper 7 having dimensions sufficient to slidably receive the tail end portion 1.

Figure 1C:
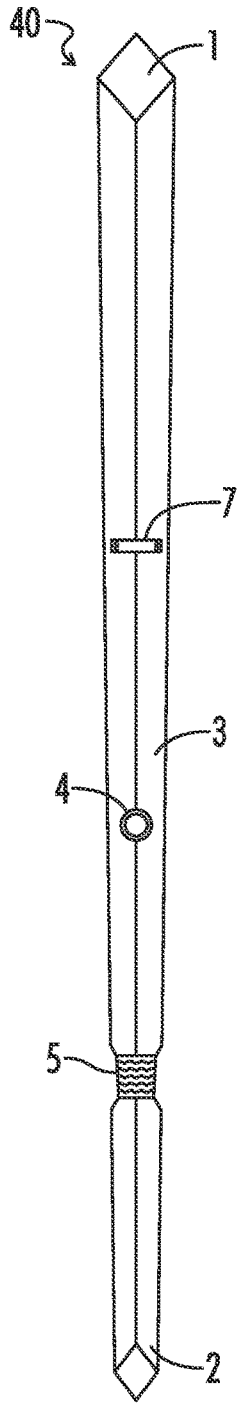

In optional embodiments, FIG. 1C depicts the tail end portion 2, which may include an elastic section 5 that enables the neck loop 24 to comfortably expand around a user's neck when a pre-knotted adjustable necktie 40 is worn. The elastic section 5 may be of different or the same material as the external panel of flexible material 26 or the internal panel of flexible material 27.

Figure 1D:
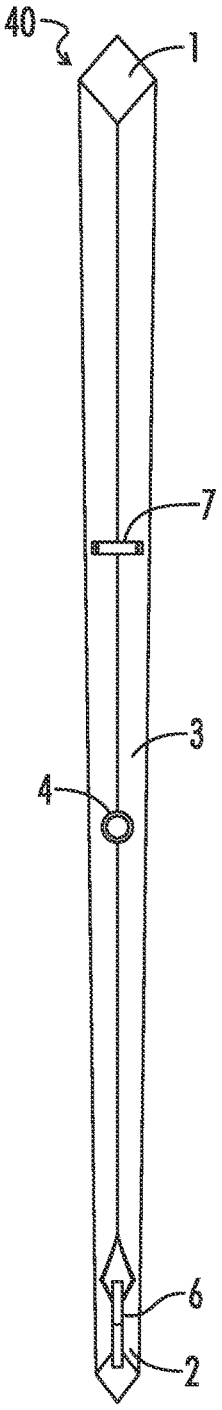
Figures 5A, 5B, 5C, 5D:
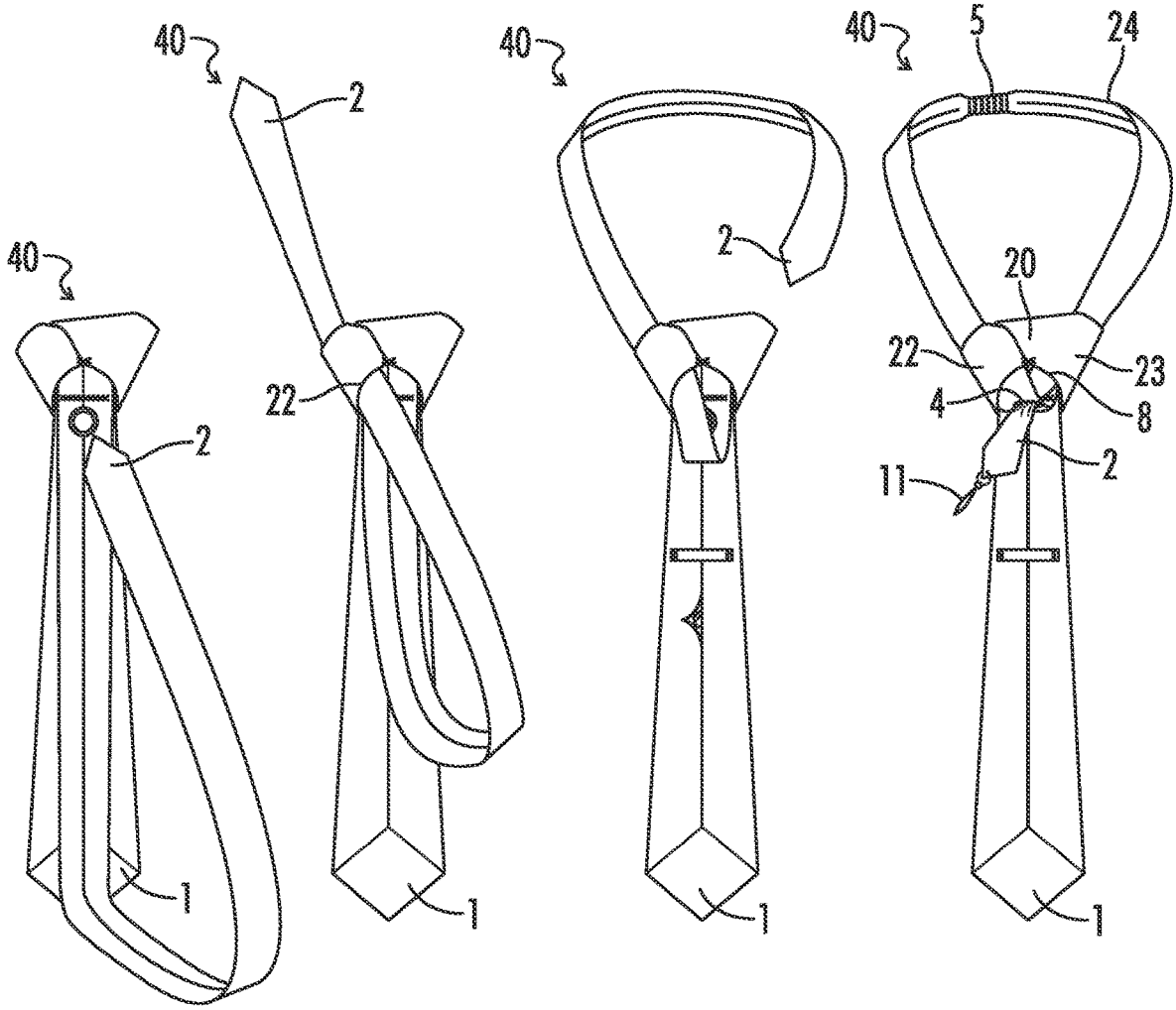
FIGS. 5A-5D illustrate a neck loop depicting an extension of the tail end through the second loop, the third loop, and the passage.

In optional embodiments, FIG. 1D illustrates a graspable interior anchor 6 housed in the tail end portion 2, which may allow the tail end portion 2 to extend through a first loop 8, a second loop 22, a third loop 23, or the passage 4, the foregoing of which are depicted in FIGS. 5B-5D. This result may also be achieved through the attachment of an external anchor 11, as depicted in FIG. 5D.

Figure 2A:
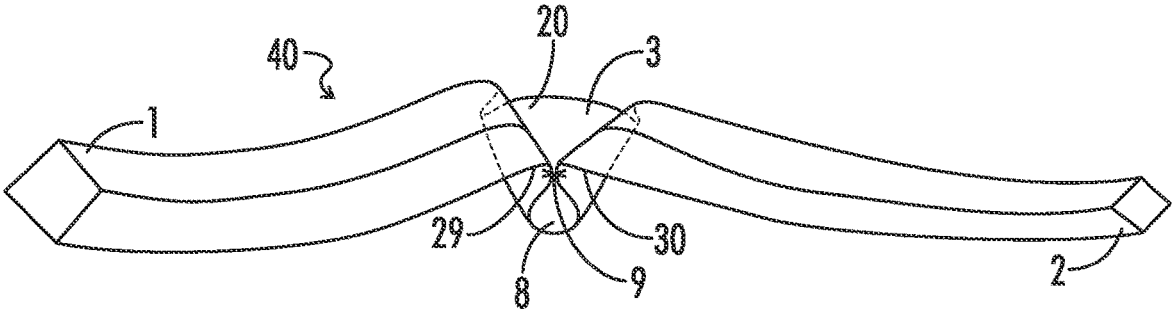
FIGS. 2A-2B illustrate a formation of a first loop with a coupling member.
Figure 2B:
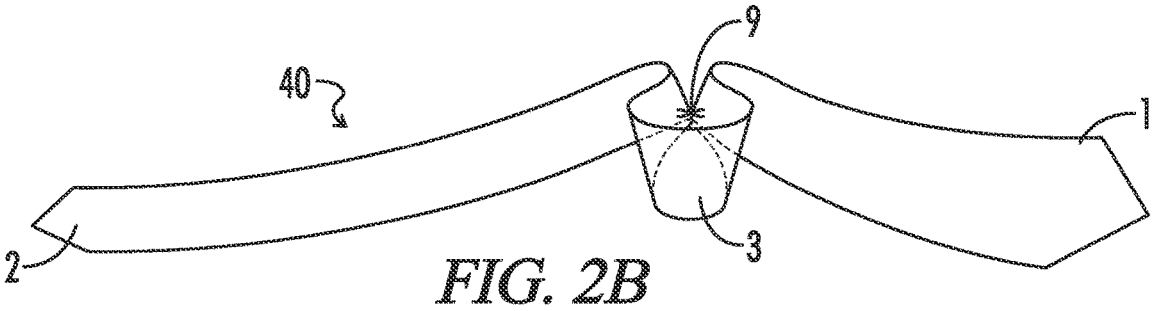

FIGS. 2A-2B depict a coupling member 9 connecting a first location 29 on an edge of the middle portion 3 with a second location 30 on an edge of the middle portion 3 to form a first loop 8, and which is positioned behind a rear side of a knot 20. In some embodiments, the first loop 8 may include a teardrop-like shape, through which the tail end portion 2 may pass.

Figure 2C:
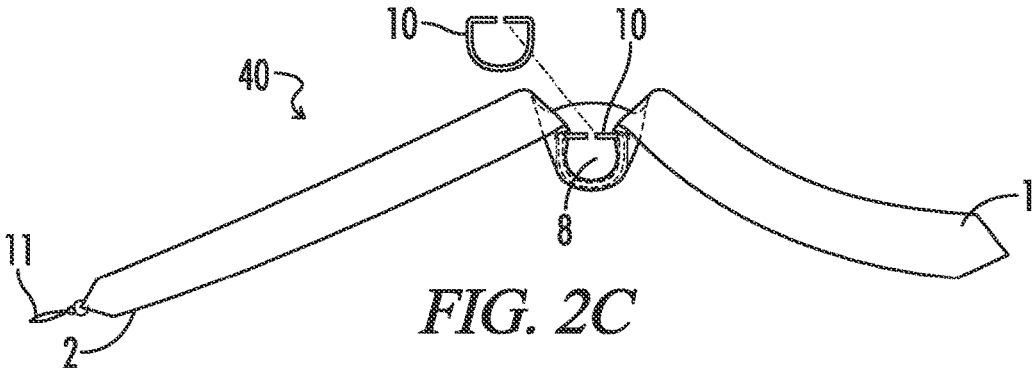
FIGS. 2C-2D illustrate a formation of the first loop with an external passage.
Figure 2D:
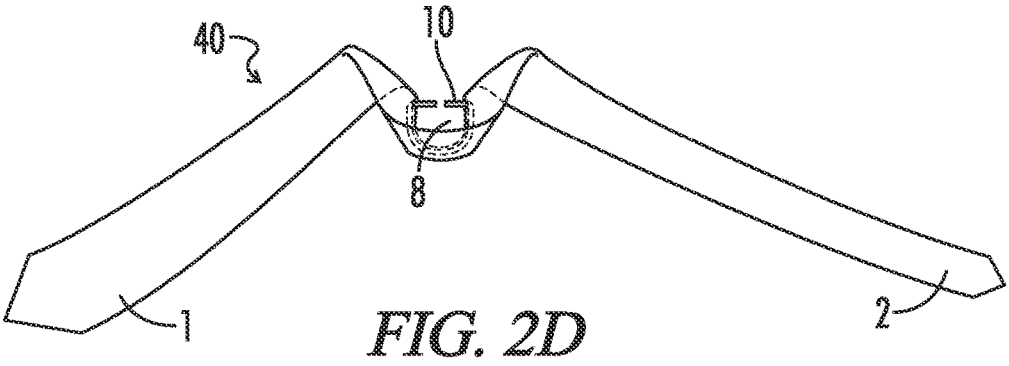

In optional embodiments, FIGS. 2C-2D illustrate a formation of the first loop 8, the first loop of which may include an external passage 10. In other optional embodiments, the external passage may include a ring, formed in the shape of a letter "D" of the English alphabet or a conventional horseshoe, though which the tail end portion 2 may pass.

Figure 3A:
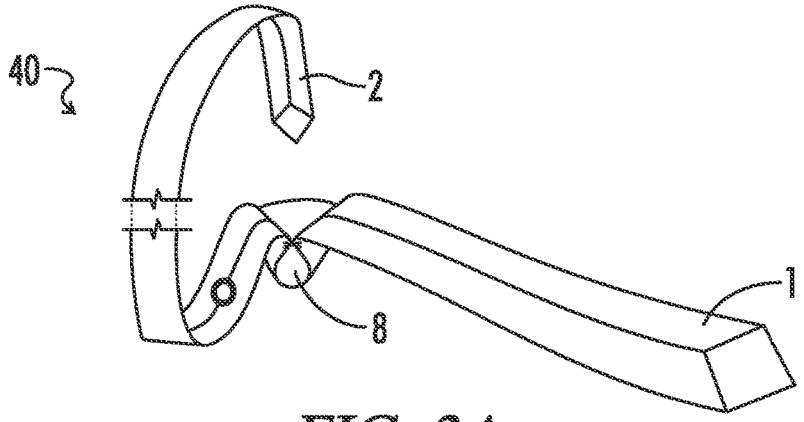
FIGS. 3A-3D illustrate the rear side of a knot wherein the tail end portion and blade end portion are extended through the first loop, forming a second loop and a third loop.
Figure 3B:
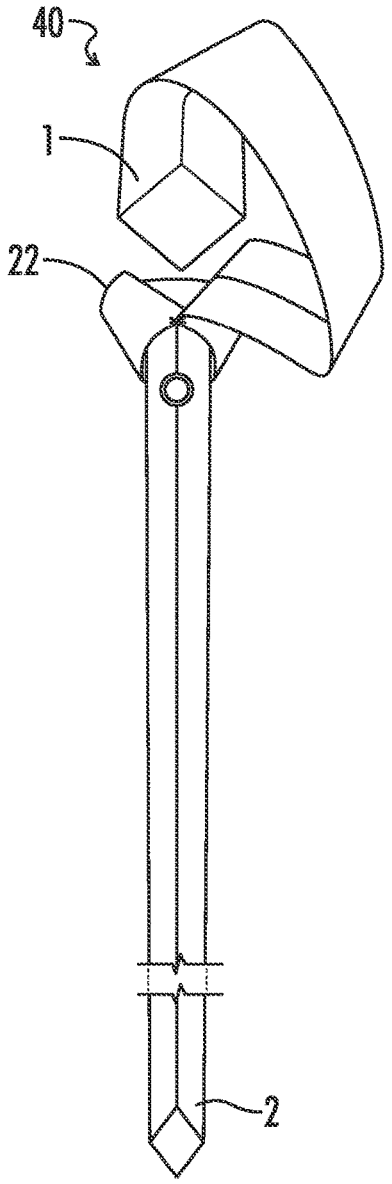
Figure 3C:
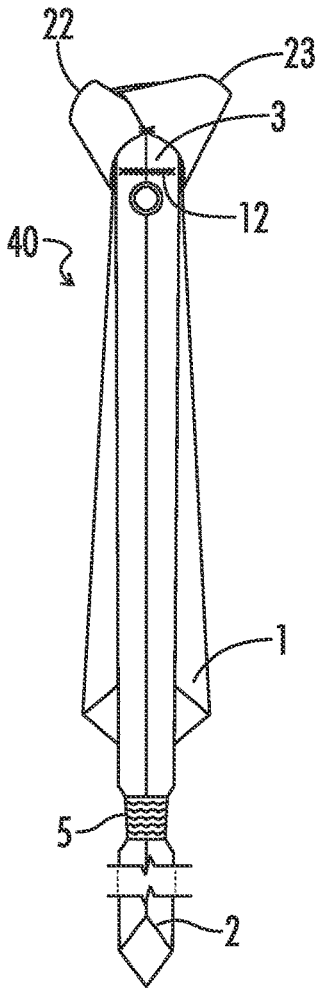

FIGS. 3A-3B depict the second loop 22, formed by an extension of the tail end portion 2 through the first loop 8. FIGS. 3B-3C depict the third loop 23, formed by an extension of the blade end portion 1 through the first loop 8, the extension of the blade end portion 1 of which may be positionally behind the tail end 2.

In optional embodiments, FIG. 3C depicts a horizontal member 12, the horizontal member 12 joining the middle portion 3 to the blade end portion 1, and positioned beneath an interior of the first loop 22 and the second loop 23.

Figure 3D:
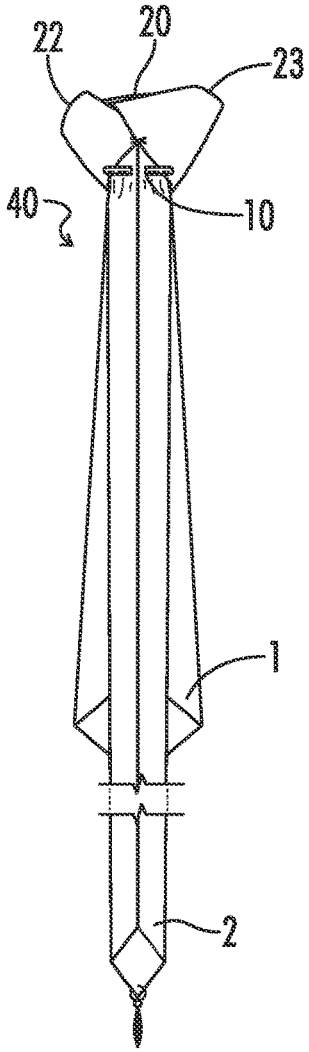

In optional embodiments, FIG. 3D depicts the external passage 10, which may be positioned at a location below the second loop 22 and the third loop 23.

Figure 4A:
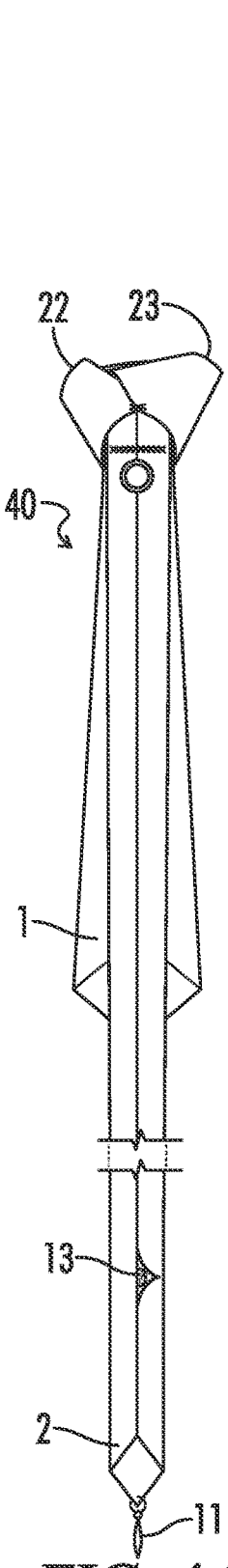
FIGS. 4A-4D illustrate the rear side (FIGS. 4A-4C) and the front side (FIG. 4D) of the knot along with accompanying embodiments.
Figure 4B:
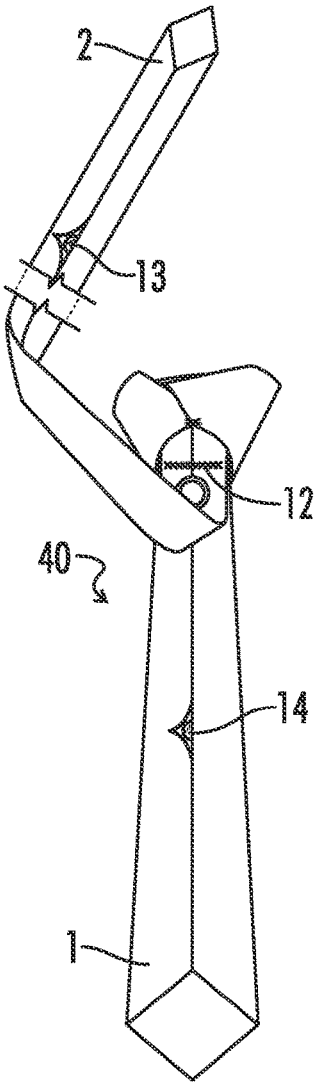

In optional embodiments, FIGS. 4A-4B depict a rear perspective of the pre-knotted adjustable necktie 40 wherein at least one magnetic plate 13 may be incorporated into the tail end portion 2. In some embodiments, at least one magnetic plate 14 may be incorporated into the blade end portion 1. FIG. 4B illustrates that the at least one magnetic plate 13 may be magnetically bonded or connected with, or attached to, the at least one magnetic plate 14, such that the tail end portion 2 and the blade end portion 1 may remain in a fixed, stable position upon formation of the completed pre-knotted adjustable necktie 40, as depicted in FIGS. 6A-6D.

Figure 4C:
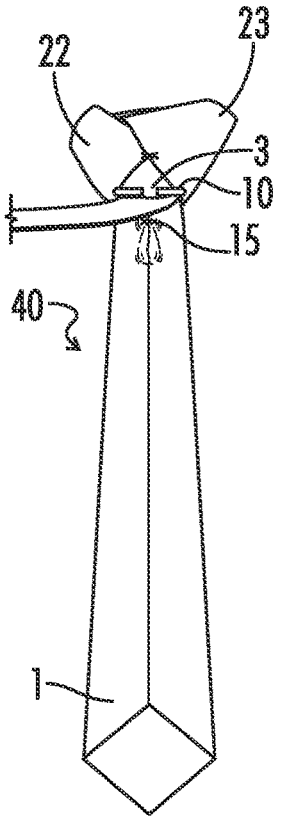

In optional embodiments, FIGS. 4C-4D a joining member 15, positioned at a location below the second loop 22 and the third loop 23, which forms a dimple 16 at a position on the middle portion 3.

Figure 4D:
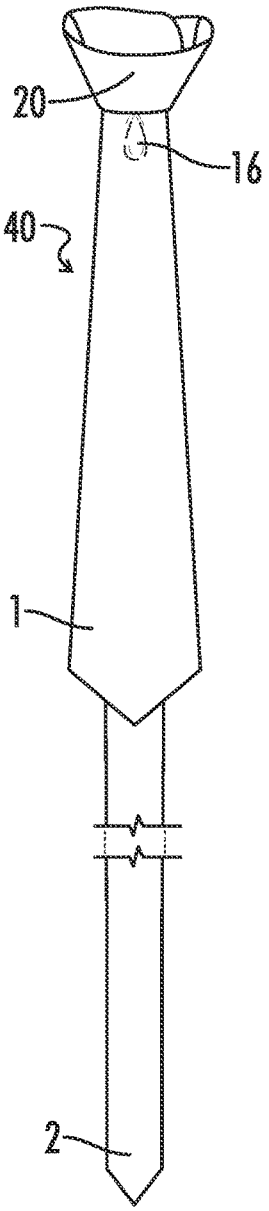

FIG. 4D illustrates a front perspective of the knot 20. In optional embodiments, FIG. 4D depicts the dimple 16 on the blade end portion 1 at a location below the knot 20.

FIGS. 5A-5D depict a formation of a neck loop 24, whereby the tail end portion 2 may extend through the second loop 22, the third loop 23, and the passage 4. The passage 4 may be positioned within the knot 20 and interior with respect to the first loop 8.

In optional embodiments, FIG. 5D depicts the neck loop 24 having an elastic section 5. In other optional embodiments, a graspable exterior anchor 11 may be attached to the tail end portion 2.

Figures 6A, 6B, 6C, 6D:
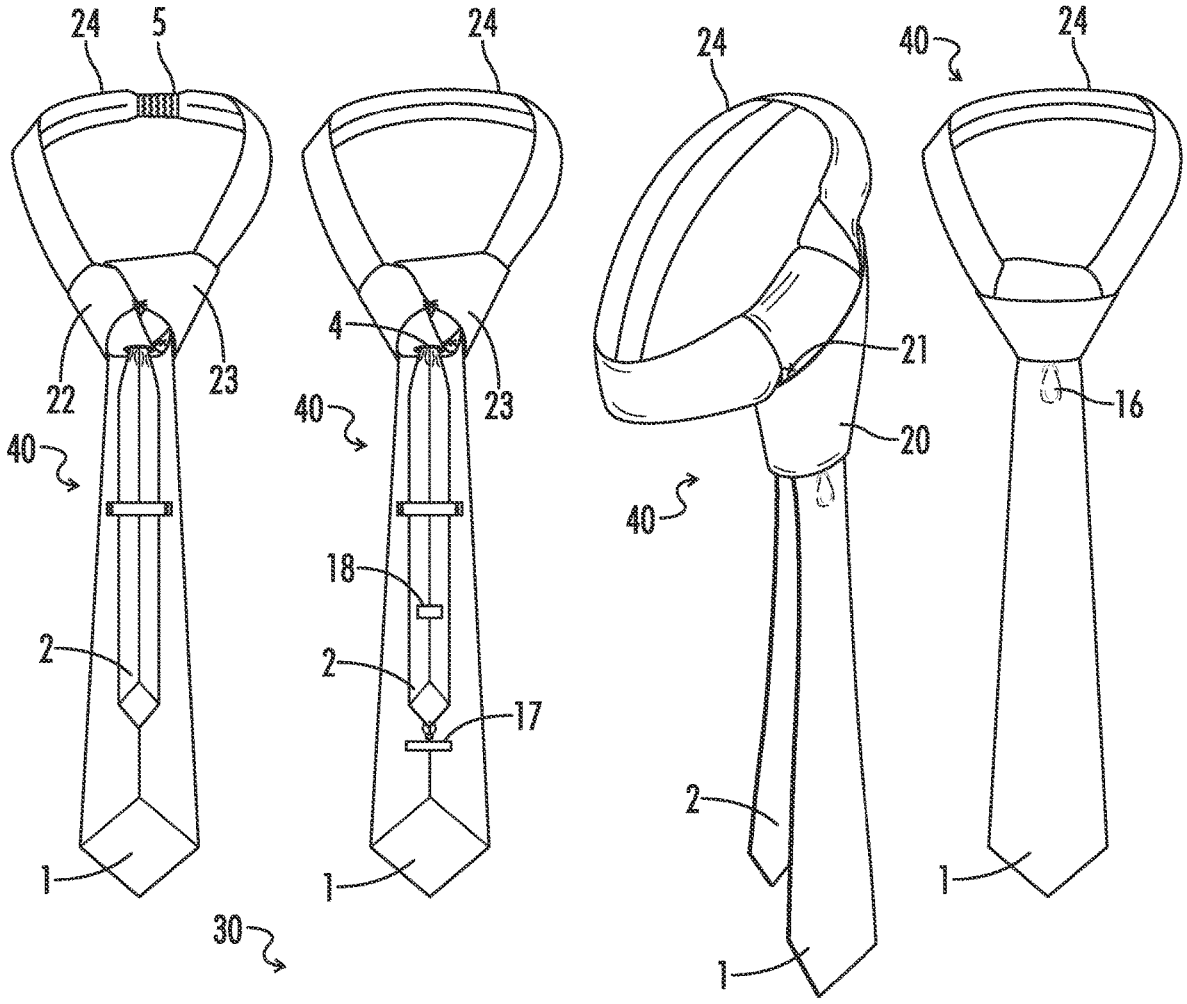
FIGS. 6A-6B illustrate a rear perspective of a completed form of the pre-knotted adjustable necktie, along with accompanying embodiments.
FIGS. 6C-6D illustrate a front perspective of a completed form of the pre-knotted adjustable necktie, along with accompanying embodiments.

FIGS. 6A-6B illustrate a rear perspective of a completed form of the pre-knotted adjustable necktie 40. In optional embodiments, FIG. 6B shows an exterior slab of rigid material 17 that may be attached to the tail end portion 2 to prevent the tail end portion 2 from extending and returning upwards through the passage 4 and the third loop 23, thereby breaching the closed and confined nature of the neck loop 24. In other optional embodiments, an interior slab of rigid material 18 may be housed in the tail end portion 2, which is configured to prevent the tail and portion 2 from returning through the passage 4 and the third loop 23.

In optional embodiments, FIG. 6C depicts a side perspective of a completed form of the pre-knotted adjustable necktie 40, where an interior portion of the rear side of the knot 20 may be adjoined at a binding position 21 to an interior portion of a front side of the blade end portion 1.

FIG. 6D illustrates a front perspective of the completed form of the pre-knotted adjustable necktie 40. In optional embodiments, FIG. 6D illustrates a front perspective of the completed form of the pre-knotted adjustable necktie 40 with the dimple 16.

Unless otherwise defined, all technical and scientific terms used herein have the same meaning as commonly understood by one of ordinary skill in the art to which this invention belongs. The present invention may be embodied in other specific forms without departing from the spirit or essential attributes thereof, and it is therefore desired that the present embodiment be considered in all aspects as illustrative and not restrictive. Any headings utilized in the description are for convenience only and no legal or limiting effect.

What is claimed is:

1. A pre-knotted adjustable necktie, comprising:

at least one panel of flexible material formed into a necktie having a proximal blade end portion, a distal tail end portion and a middle portion, the middle portion positioned between the blade end portion and the tail end portion;

an external passage coupled to the middle portion of the flexible material, the external passage having a sufficient size to slidably receive the tail end;

a coupling member connecting a first location on an edge of the middle portion with a second location on the edge of the middle portion forming a first loop in the middle portion along the edge;

a knot comprising the tail end portion extended through the first loop to form a second loop and the blade end portion extended through the first loop forming a third loop, the blade end portion extending downward from the knot; and a neck loop comprising the tail end portion extending through the second loop, extending through the third loop, and passing through the passage, the tail end portion movable within the third loop and the passage to adjust the length of the length of the neck loop.

2. The pre-knotted adjustable necktie of claim 1 wherein the middle portion of the necktie comprises an elastic material.

3. The pre-knotted adjustable necktie of claim 1 wherein the external passage comprises a ring.

4. The pre-knotted adjustable necktie of claim 3 wherein the ring is D-shaped.

5. The pre-knotted adjustable necktie of claim 1, wherein the external passage is coupled to flexible material along the edge of the middle portion between the first and second locations on the edge of the middle portion.

6. The pre-knotted adjustable necktie of claim 5 wherein the first and second locations on the edge of the middle portion are spaced apart from the external passage.

7. The pre-knotted adjustable necktie of claim 1 wherein the coupling member comprises a thread sewn between the first location on the edge of the middle portion and the second location on the edge of the middle portion.

8. The pre-knotted adjustable necktie of claim 1 wherein the coupling wire comprises a thing wire.

9. The pre-knotted adjustable necktie of claim 1 wherein the knot has a triangular shape.

10. The pre-knotted adjustable necktie of claim 1 wherein the middle portion of the necktie is secured to the blade end portion of the necktie at a location of the blade end portion proximate to the knot.

11. The pre-knotted adjustable necktie of claim 1 wherein the tail end portion comprises at least one magnetic plate, and the blade end portion comprises at least one magnetic plate.

12. The pre-knotted adjustable necktie of claim 1 wherein the tail end portion contains an exterior anchor attached to the tail end portion, the exterior anchor graspable to pull the tail end portion through the first loop, the second loop, the third loop, and the external passage.

13. The pre-knotted adjustable necktie of claim 1 wherein the tail end portion contains an interior anchor housed in the tail end portion, the interior anchor graspable to pull the tail end portion through the first loop, the second loop, the third loop, and the external passage.

14. The pre-knotted adjustable necktie of claim 1 wherein the tail end portion contains an exterior slab attached to the tail end portion, configured to prevent the tail end portion from returning through the external passage.

15. The pre-knotted adjustable necktie of claim 1 wherein the tail end portion contains an interior slab housed in the tail end portion, configured to prevent the tail end portion from returning through the external passage.

16. The pre-knotted adjustable necktie of claim 1 wherein the knot has a rear side and the blade end portion has a front side, an interior portion of the rear side of the knot adjoined to an interior portion of the front side of the blade end portion.

17. The pre-knotted adjustable necktie of claim 1 wherein the middle portion comprises a joining member located proximate to an interior portion of a front side of the knot, the joining member squeezing at least two edges of the flexible material.

* * * * *